United States Patent [19]

Monschke

[11] 4,200,235

[45] Apr. 29, 1980

[54] MULTIPLE PIECE TORCH TIP

[75] Inventor: Charles P. Monschke, Krum, Tex.

[73] Assignee: Victor Equipment Company, Denton, Tex.

[21] Appl. No.: 892,971

[22] Filed: Apr. 3, 1978

[51] Int. Cl.[2] ..... B05B 7/06

[52] U.S. Cl. ..... 239/424.5

[58] Field of Search ..... 239/416.5, 421, 423, 239/424, 424.5, 425, 552; 29/157 C

[56] References Cited

U.S. PATENT DOCUMENTS

| | | | |
|---|---|---|---|
| 1,186,962 | 6/1916 | Wright | 239/424.5 X |
| 1,731,265 | 10/1929 | Quelch | 239/424.5 |
| 2,351,787 | 6/1944 | Smith | 239/424.5 |
| 3,558,062 | 1/1971 | See | 239/424 X |
| 3,838,820 | 10/1974 | Pearce | 239/424.5 |

*Primary Examiner*—Johnny D. Cherry

*Attorney, Agent, or Firm*—Wofford, Fails & Zobal

[57] ABSTRACT

A multiple piece torch tip and a method of making a multiple piece torch tip. The multiple piece torch tip comprises an inner piece disposed interchangeably within an outer piece. The inner surface of the outer piece has a plurality of regularly spaced slots which decrease in size radially outward and which combine with the smooth exterior of the inner piece to form preheat orifices. The method of making the multiple piece torch tip comprises a swaging step which in one step forms the outer piece. In the swaging step a tubular blank is swaged about a ribbed mandrel. The mandrel presents a monotonically decreasing radial cross-sectional area with respect to the blank for facilitating removal of the swaged outer piece without damage thereto. Also provided is a step of forming an inner piece of a size such that the inner surface of the outer piece and the outer surface of the inner piece combine to form preheat orifice configurations.

3 Claims, 7 Drawing Figures

11
13
15
17
19
21
23
25
27
29
31
33
35
37
39
41
43
44
45
47
49

MULTIPLE PIECE TORCH TIP

BACKGROUND OF THE INVENTION

1. Field of the Invention

The present invention relates, in general, to torch tips and to a method of making torch tip pieces.

2. Description of the Prior Art

Torch tips, which are also known as blowpipe tips or cutting tips, serve to direct a stream of oxygen for cutting metals. The oxygen so directed passes through a central orifice in the tip called the cutting orifice. Surrounding the cutting orifice are a plurality of smaller orifices called the preheat orifices. A mixture of fuel gas and oxygen is passed through the preheat orifices to preheat the metal for cutting and to insulate the cutting oxygen from contamination by the surrounding air. To properly perform this function, the preheat orifices must be located precisely around the cutting orifice in a proper orientation. Torch tips with these features have, in the past, been made by three basic methods producing two basic styles of tips.

The older style is the single piece torch tip. One way of making this style of tip is by drilling. First, a solid blank of material, such as copper, is shaped in the form of a torch tip. Next, the cutting orifice and the preheat orifices are formed in the blank by drilling. Since drilled holes are limited in the minimum diameter attainable, it is often desired to make the orifices smaller. This improves their combustion properties such that the fuel gases more efficiently heat the workpiece. In this first method, this has been done by inserting piano wires in the drilled holes, swaging the tip around the wires, and then pulling the wires free. The problem with this method is that it is slow, the drills do not drill straight enough to optimally locate the orifices, the drills break frequently, and it is limited in the number of preheat orifices which can be located about the cutting orifice.

Another method of making the single piece type of tip is by swaging or drawing together two separate pieces. U.S. Pat. Nos. 3,716,902 and 2,254,757 reveal such a method. First, an outer piece is formed with longitudinal slots along its interior. Next, an inner piece, with a drilled cutting orifice, is placed inside the outer piece. Piano wires of the proper size are positioned in the appropriate locations. Finally, the composite of the inner and outer pieces is swaged together to the proper size and the wires are removed. This method is less expensive than the first method but problems remain. In this method, the number and shape of the preheat orifices is still limited, since the columns between the orifices must support the outer piece against the swaging force. Moreover, the ability to precisely orient the preheat orifices is less than optimum.

The other style of torch tip is a two piece design. An example of this type of tip is revealed in U.S. Pat. No. 2,468,824. The outer piece of this type of tip is made by forming a shell with a smooth interior. The inner piece is made by milling rectangular slots into the exterior of a blank piece of metal and drilling a cutting orifice into the center thereof. The smooth inner surface of the outer piece and the milled slots of the inner piece combine to form preheat orifices. By using a milling process, an increased number of preheat orifices is possible. Since gases other than acetylene require more preheat orifices due to their lower burning temperature, this type of tip is the type most desired for these other gases. Another advantage of this type of tip is its interchangeability. Due to rough handling, torch tips often are damaged while in use. The two piece design allows the inner or outer piece to be replaced without replacing the entire tip. Its disadvantage is that when a large number of slots are milled into the outer surface of the inner piece, thin "vanes" are formed which are easily broken. This subjects the inner piece to being easily damaged, especially during the process of interchanging pieces. In addition, the milling process often leaves burrs or other irregularities in the slots which cause improper burning through the preheat orifices. Finally, milling slots into the inner piece is limited in the shapes of preheat orifices which can be created. Thus, only rectangular slots, with vertical walls or slots which increase in size radially outward are possible.

SUMMARY OF THE INVENTION

It is accordingly an object of the present invention to provide a multiple piece torch tip having improved durability and interchangeability. It is a further object of the present invention to provide a multiple piece torch tip with improved preheating ability.

It is also an object of the present invention to provide a less expensive and more efficient method of making torch tip pieces. It is a further object of the present invention to provide a method of making torch tip pieces which improves the quality of the finished torch tip pieces.

In accordance with the present invention, there is provided a multiple piece torch tip having an inner piece and an outer piece. The tubular outer piece has an entrance end and an exit end. A plurality of regularly spaced longitudinal slots are provided along the exit end of the interior surface of the outer piece. These slots decrease in size radially outward. The inner piece is interchangeably disposed within the outer piece and has a smooth exterior surface which combines with the slots of the outer piece to form preheat orifices.

Also in accordance with the present invention, there is provided a method of forming the outer piece of a multiple piece torch tip. In this method, a hardened steel mandrel is formed and a tubular blank of metal is swaged about the mandrel to form the outer piece in a single step. The mandrel has a plurality of regularly spaced ridges on its exterior surface for forming slots on the inner surface of the outer piece. The mandrel presents a decreasing radial cross-sectional area with respect to the tubular blank for facilitating removal of the swaged outer piece without damage.

Also in accordance with present invention is provided a method of making a multiple piece torch tip. This method includes the method of making outer pieces as described above and a method of forming inner pieces. The inner piece is formed such that its exterior surface can combine with the interior surface of the outer piece to form preheat orifice configurations.

For a further understanding of the invention and further objects, features, and advantages thereof, reference may now be had to the following description, taken in conjunction with the accompanying drawings.

DESCRIPTION OF THE PREFERRED EMBODIMENT

Figures 1, 2, 3, 4, 5, 6, 7:
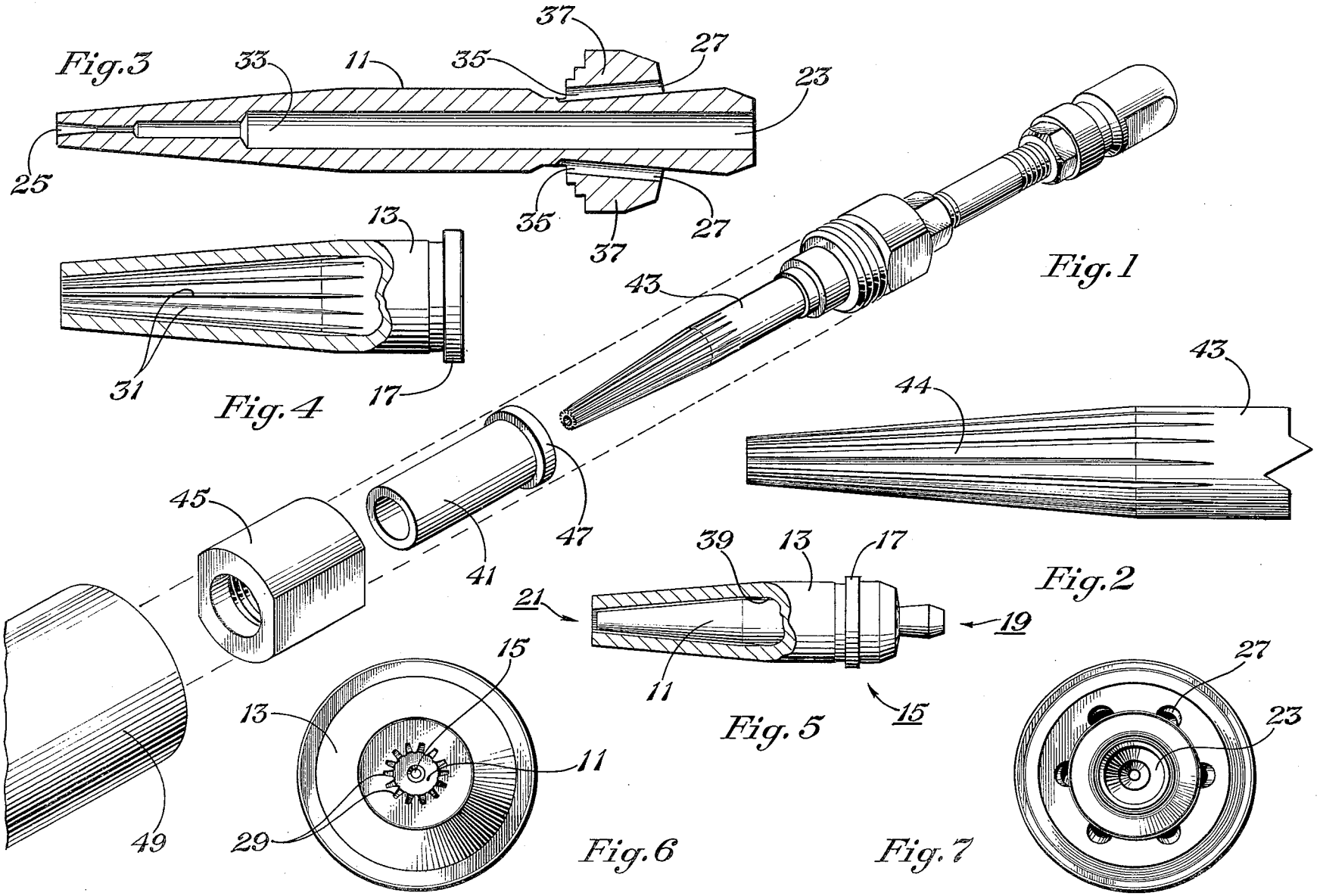
FIG. 1 is an exploded view of the mandrel-blanknut assembly of the swaging process of the present invention.
FIG. 2 is an enlarged view of the tip of the mandrel of FIG. 1.
FIG. 3 is a cross-sectional view of the inner piece of the multiple piece torch tip of the present invention.
FIG. 4 is a partially cutaway side view of the outer piece of the multiple piece torch tip of the present invention.
FIG. 5 is a partially cutaway side view of the multiple piece torch tip of the present invention.
FIG. 6 is a front end view of the multiple piece torch tip of FIG. 5.
FIG. 7 is a rear end view of the multiple piece torch tip of FIG. 5.

Referring now to FIG. 5, the torch tip of present invention is shown in cutaway view to reveal the manner in which the inner piece 11 and the outer piece 13 combine to form the multiple piece torch tip 15. The inner piece 11 and the outer piece 13 are shown separately in more detail in FIGS. 3 and 4, respectively. When attached to a complete torch apparatus, a nut (not shown) extends over a flange 17 on the outer piece 13 to sealingly join the rear of the torch tip to a handle (also not shown). This handle contains supply lines which are connected to the oxygen and fuel gas used for cutting. These handles are conventional and have standard size receiving parts for attaching various torch tips.

Referring to FIGS. 3, 5 and 7, the torch tip 15 has an entrance end 19 at the rear of the tip and an exit end 21 at the front of the tip. A view of the entrance end is shown in FIG. 7 and a view of the exit end is shown in FIG. 6. These ends are so named since they correspond to the ends where the gases enter and exit. Thus, the oxygen for cutting is supplied to the tip through a port 23 at the entrance end 19 and exits for cutting through a cutting orifice 25 at the exit end 21. In a similar manner, a combustible admixture, including the fuel gas, used for preheating the workpiece, is supplied to the tip through ports 27 at the entrance end 19 and is expelled for preheating through the preheat orifices 29 at the exit end 21.

The inner piece 11 is interchangeably disposed within the outer piece 13. Thus, if one of these pieces is damaged, the nut which sealingly holds them to the handle is removed and the pieces are separated. The damaged piece is then replaced and the tip is rejoined to the handle.

The outer piece 13, shown separately in FIG. 4, has a tubular shape. In a preferred embodiment, this tubular shape has a frusto-conical exit end. Extending along the interior of the exit end of the outer piece 13 are a plurality of regularly spaced slots 31. Thus, the slots of the outer piece define a frusto conical shape converging in the direction of the exit end of the outer piece. These slots 31 extend longitudinally and decrease in size radially outward.

The inner piece 11, shown separately in FIG. 3, is sized to fit closely within the outer piece 13. Disposed longitudinally through the interior of the inner piece 11 is a passage, or conduit, 33. Port 23 and the cutting orifice 25 are ends of this conduit 33.

When the inner piece 11 and the outer piece 13 are joined they form the torch tip 15, as shown in FIG. 5. At the exit end 21, the slots 31 combine with the exterior of the inner piece 11 to form the preheat orifices 29. These preheat orifices surround the cutting orifice 15 in a circular pattern. The operation of the torch tip 15 will now be described in more detail.

Referring now to FIG. 3, the oxygen used for cutting the workpiece enters the torch tip through port 23. It passes through the conduit 33 and exits the torch tip at the cutting orifice 25. The oxygen supplied to the torch tip is under fairly high pressure and, therefore, leaves cutting orifice 25 as a high velocity stream. This stream contacts and causes oxidation of the workpiece. At the same time, the force of the stream of oxygen pushes aside the burned material.

Referring now to FIGS. 3, 5, 6 and 7, a mixture of the oxygen and the fuel gas used mainly for preheating the workpiece enters the torch tip through ports 27. These ports 27 lead into passages, or conduits, 35. Conduits 35 are contained within a rim portion 37 of the inner piece 11 located at the rear of the inner piece 11. These conduits 35 lead, in turn, into an annular chamber 39 created by a gap between the inner piece 11 and the outer piece 13. This gap is sustained since the inner piece 11 contacts the outer piece 13 only at the rim 37 and at the exit end 21. At the exit end 21, the chamber 39 merges into the preheat orifices 29 due to the slots 31 in the interior wall of the outer piece 13. Otherwise, the respective outer and inner walls of the inner and outer pieces are contiguous and block flow. Thus, it can be seen that the combustible admixture of oxygen and fuel gas passes respectively through the ports 27, the conduits 35, the chamber 39, the slots 31 and the preheat orifices 29.

As the combustible admixture leaves the preheat orifices 29, it is ignited by the flame which is maintained by the previously burning fuel gas. This flame preheats the workpiece to a temperature which allows the oxygen to cut the workpiece as described above. In addition, since the preheat orifices surround the cutting orifice, the fuel and oxygen gases leaving the preheat orifices surround the cutting oxygen to insulate the oxygen from contamination by the air. This allows faster preheating and more efficient cutting.

By having the slots 31 and, therefore, the cutting orifices 29 decrease in size radially outward, the cutting oxygen is more effectively insulated. This is so since the largest opening in each preheat orifice is closer to the cutting orifice creating a tighter circle of expelled fuel gas. In addition, preheat time is reduced since the heat is concentrated closer to the point where the oxygen stream will strike. This allows the tip to start cutting faster and to cut with less oxygen and fuel gas. The effect of these factors is enhanced by the frusto-conical shape of the outer piece 13. This shape of tip focuses the expelled gas to remain closer to the cutting oxygen.

Locating the slots 31 in the outer piece 13 allows the tip pieces to remain cooler during cutting. As the tip is used it heats up due to radiation and convection from the cutting areas. By locating the preheat orifice slots in the outer piece more surface area of the outer piece is exposed to cool preheat gases which pass through the tip and, therefore, the outside of the tip stays cooler. This increases the life of the tip.

Locating the slots 31 in the outer piece 13 also protects the tip from damage. The most vulnerable part of a two-piece torch tip are the vanes or thin ridges formed by the slots which define the walls of the preheat orifices. These vanes are particularly vulnerable when the inner and outer pieces are separated. By locating these vanes on the interior of the outer piece 13 these vanes are protected from damage due to an inadvertent blow. Additional protection is provided by the slots decreasing in size radially outward. This gives the vanes a larger base and, therefore, a stronger resistance to bending or breaking. This protection is important since a bent vane creates a break in the circle of preheat gases and produces a lower cutting efficiency.

In a preferred embodiment of the present invention, there are at least eight preheat orifices in the tip. The number of orifices will vary with the type of fuel gas and the size of the cutting oxygen orifice. Any number of orifices up to 32 or more can be employed, but an average number would be approximately fourteen. This improves the preheating efficiency by protecting the oxygen from contamination as described above. In addition, this allows the tip to be used with gases other than acetylene. The other gases burn at a lower temperature and, therefore, require more openings to get the same amount of preheating.

Referring now to FIG. 1, the present invention also provides a method of making a multiple piece torch tip. First there is formed a master mandrel 43, as indicated herein. The outer piece of the multiple piece tip is made by swaging a blank 41 about the mandrel 43. This method allows the outer piece to be formed in a single step. The inner piece 11, shown in FIG. 3, is formed to fit within the outer piece 13.

The end of mandrel 43 is shown in greater detail in FIG. 2. Mandrel 43 is made of precision ground hardened steel which allows the mandrel to be used in forming hundreds of outer pieces. It has a plurality of ridges 44 for forming the slots 31 in the swaged outer piece 13. The ridges 44 are precisely located and are rigid enough to affect precisely shaped and located passages, in contrast to the prior art. The ridges 44 decrease in size radially outward. The mandrel 43 also decreases in radial cross-sectional area toward its tip. The combination of the ridges decreasing outwardly and the mandrel decreasing toward its tip provides a total monotonic decrease in radial cross-sectional area with respect to the blank 41. Thus, inherently each ridge of the mandrel and, consequently, each slot, monotonically decreases toward the exit end of the tip. This is important since it allows the swaged outer piece to be removed without damage and leaves smooth passage walls. The swaging of the outer piece of the multiple piece torch tip will now be described in more detail.

The swaging of the outer piece is performed in a swager 49. The details of the swager 49 are not shown since swaging devices are old in the art. Basically, they perform a hammering function on a piece of metal placed in the proper location. The hammering shapes and forces, or cold flows, the metal to a predetermined external shape and onto and in conforming relationship with a mandrel. In the present invention, the swaging is performed on a tubular metal blank 41. This blank 41 has a flange 47 which allows a nut 45 to hold the blank fast to the mandrel 43. The mandrel-blank-nut assembly is then fed into the swager 49.

The swager 49 flows the metal to form a completed outer piece in a single step. In other words, no other steps such as annealing, milling, adding wires and reswaging, buffing, grinding, etc. are required in the shaping of the outer piece. The swaging produces an outer piece which has substantially smooth slots 31. While swaging, in the prior art, produced some irregularities due to uneven cold flow of the interior walls, the walls are supported in this invention. This method also eliminates the burrs formed by the former and more expensive milling process.

After the swaging, the outer piece must be removed from the mandrel 43. Since swaging produces a close metal to metal contact this process is difficult to accomplish without damaging the softer outer piece; especially the thin vanes formed on the interior of the outer piece. However, removal can be accomplished without damage by using a mandrel which has a decreasing radial cross-sectional area with respect to the tubular blank. This allows a very small motion of the swaged piece to free the swaged piece from the mandrel. This small freeing motion does not damage the surfaces of the outer piece and leaves substantially smooth walls on the passages for low turbulence, better flow, and the like.

The inner piece of the multiple piece torch tip is formed to fit within the outer piece. This must be a tight fit at the exit end in order that the slots on the interior of the outer piece can join with the smooth exterior of the inner piece to form preheat orifice configurations . In making the inner piece, a solid blank of material, such as brass, is drilled to provide a cutting orifice through the center thereof. The exterior of the inner piece is turned to provide the rim portion at the rear and the conduits are drilled in this rim portion. Finally, the exit end of the inner piece is carefully turned to fit closely within the outer piece 13.

Together, this method of forming a multiple piece torch tip is more economical and produces an improved tip. The method is more economical since only a single swaging step is required in forming the slots for the preheat orifices. It produces an improved tip since it results in a smoother finish on these slots. It also allows an increased number of slots to be formed due to the accurate location of the ridges 44 on the precision ground mandrel. This accuracy also positions the slots more accurately which reduces preheat time. The method also provides slots 31 which decrease in size radially outward. As described before, this improves the cutting efficiency and protects the tip from damage.

The foregoing disclosure and the showings made in the drawings are merely illustrative of the principles of this invention and are not to be interpreted in a limiting sense.

What is claimed is:

1. A multiple piece torch tip comprising:

a. a tubular outer piece having an entrance end and an exit end and a plurality of at least eight regularly spaced, generally longitudinal slots along the exit end of the interior surface of said outer piece; the slots of said outer piece decreasing in size radially outwardly and monotonically decreasing in cross sectional area toward said exit end such that said slots of said outer piece define a generally frusto-conical shape converging in the direction of the exit end of said outer piece; and b. an inner piece interchangeably disposed within said outer piece; said inner piece having an interior passageway penetrating longitudinally therethrough for cutting oxygen passage and having an exterior of a frusto-conical shape conformingly fitting at least a portion of said interior surface of said outer piece and of a size such that the exterior of the inner piece combines with the peripheral walls of the slots on the interior of the outer piece to form preheat orifice configurations of said frusto-conical shape converging in the direction of the exit end of said outer piece and spaced substantially equally about said cutting oxygen passageway traversing longitudinally of the center of said inner piece.

2. The torch tip of claim 1 wherein there are more than 8 slots in said outer piece.

3. The torch tip of claim 1 wherein there are at least 14 said slots formed in said outer piece.

* * * * *